US009889536B2

(12) United States Patent
Bradshaw

(10) Patent No.: US 9,889,536 B2
(45) Date of Patent: Feb. 13, 2018

(54) ANGLE GRINDER CONTROL SYSTEMS

(71) Applicant: Brett George Bradshaw, Williams Lake (CA)

(72) Inventor: Brett George Bradshaw, Williams Lake (CA)

( * ) Notice: Subject to any disclaimer, the term of this patent is extended or adjusted under 35 U.S.C. 154(b) by 0 days.

(21) Appl. No.: 14/986,305

(22) Filed: Dec. 31, 2015

(65) Prior Publication Data

US 2017/0190014 A1 Jul. 6, 2017

(51) Int. Cl.
*B24B 23/02* (2006.01)

(52) U.S. Cl.
CPC ..... *B24B 23/028* (2013.01)

(58) Field of Classification Search
CPC ..... B24B 23/02; B24B 23/028
USPC ..... 451/359, 358, 442, 451
See application file for complete search history.

(56) References Cited

U.S. PATENT DOCUMENTS 3,110,993 A * 11/1963 Grage ..... B24D 7/10 451/450
4,033,077 A * 7/1977 Chester ..... B24B 23/028 200/332
6,602,122 B1 7/2003 Rudolf et al.
7,204,744 B2 4/2007 Lamprecht et al.
8,087,977 B2 1/2012 Gallagher et al.
8,388,418 B2 * 3/2013 Greer ..... B24B 23/02 451/358
2009/0104861 A1 4/2009 Van Der Linde et al.
2014/0054146 A1 2/2014 Hiller
2014/0158391 A1 6/2014 Xin et al.
2014/0349556 A1 * 11/2014 Zhang ..... B25F 5/02 451/359

* cited by examiner

*Primary Examiner* — Robert Rose
(74) *Attorney, Agent, or Firm* — Integrity Patent Group, PLC; Edwin Wold

(57) ABSTRACT

An angle grinder control system including an angle grinder control assembly. The angle grinder control assembly includes an outer-shell, a tightening-rod, an inner-shell, a control-rod, a return-spring, a trigger, and a control-rod-pin. The outer-shell includes a first-half-body-section and a second-half-body-section, where the inner-shell includes a primary-half-body-section and a secondary-half-body-section. The angle grinder control system provides a user an alternate means for controlling an angle-grinder-on/off-switch such that the angle grinder control system provides for safe use of an angle grinder in relation to the user. Embodiments of an angle grinder control system may include vents to promote cooling of the angle grinder. Additional embodiments many include a handle to aid the user in controlling and manipulating the angle grinder.

20 Claims, 5 Drawing Sheets

ANGLE GRINDER CONTROL SYSTEMS

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of power tools and more specifically relates to angle grinder control systems.

2. Description of Related Art

An angle grinder is a handheld power tool used for cutting, grinding and/or polishing. A motor drives the grinder head which is geared usually at a right-angle. On the grinder head is mounted an abrasive disc, cut-off disc, wire wheel or other attachment which is removable and replaceable.

Angle grinders are widely used in metalworking, construction and mechanical repair and are commonly found in shops, garages and auto body repair facilities. Generally disc size and power increase together. Common disc sizes for angle grinders range from four to twelve inches. The larger sized angle grinders generally have more power and are operated by a trigger and include an auxiliary handle for safety and control. The smaller sized angle grinders are generally operated by an on/off switch and generally do not include a handle. One limitation with the smaller size angle grinders is the lack of available handle and trigger operation for improved safety. Some small angle grinders may include a handle and trigger control switch, limiting the use of such an angle grinder to larger grinding tasks. There is a need to provide a system to allow a user to removably install a handle and trigger control on a small angle grinder, while still providing the flexibility to remove the handle and trigger. Therefore a suitable solution is desired.

Several attempts have been made to solve the above-mentioned problems such as those found in U.S. and foreign Pat. and Pub. Nos. CN 203,045,478 to Zhang, CN 104,117,892, CN 202,411,995 to Haodong, DE 19,707,215 to Ogawa et al., DE 19,507,955 to Nieberle et al., U.S. Pat. No. 6,602,122 and DE 19,900,404 to Rudolf et al., US 2009/0104861 to Van Der Linde et al., U.S. Pat. No. 7,204,744 to Lamprecht et al., U.S. Pat. No. 8,087,977 to Gallagher et al., US 2014/0054146 to Hiller, and US 2014/0158391 to Xin et al. This art is representative of power tools. However, none of the above inventions and patents, taken either singly or in combination, is seen to describe the invention as claimed.

Preferably, an angle grinder control system should provide a device to allow a user to removably install a handle and trigger control switch on a small angle grinder, while still providing the flexibility to selectively remove the handle and trigger when desired, yet would operate reliably and be manufactured at a modest expense. Thus, a need exists for a reliable angle grinder control system to avoid the above-mentioned problems.

BRIEF SUMMARY OF THE INVENTION

In view of the foregoing disadvantages inherent in the known power tools art, the present invention provides a novel angle grinder control system. The general purpose of the present invention, which will be described subsequently in greater detail is to provide a device to allow a user to removably install a handle and trigger control switch on a small angle grinder, while yet providing the desired flexibility to remove the handle and trigger as desired. The present invention serves to promote safety during angle grinder usage.

An angle grinder control system is disclosed herein, in a preferred embodiment, the angle grinder control system comprising an angle grinder control assembly. The angle grinder control assembly, in preferred embodiments, comprises an outer-shell, a tightening-rod, an inner-shell, a control-rod, a return-spring, a trigger, and a control-rod-pin. The outer-shell comprises a first-half-body-section and a second-half-body-section, wherein the inner-shell comprises a primary-half-body-section and a secondary-half-body-section.

The angle grinder control system is structured and arranged to provide a user an alternate means for controlling an angle-grinder-on/off-switch such that the angle grinder control system provides for safe use of an angle grinder in relation to the user.

The first-half-body-section and the second-half-body-section of the outer-shell are structured and arranged to be removably affixable to each other in a clamped condition. In a preferred embodiment, the outer-shell may comprise air vents to aid in cooling of the angle grinder and the air vents are preferably configured on opposing sides of the body of the angle grinder as to not interfere with (normal) use of the angle grinder by the user. In a preferred embodiment, the air vents are located on opposing sides of the body of the angle grinder, such that when used, at least one hand of the user does not obstruct air flow into or out of the air vents.

When the inner-shell and the outer-shell are in the clamped condition, the inner-shell and outer-shell are structured and arranged such that the outer-shell holds the inner-shell adjacent to the angle grinder. The outer-shell and the inner-shell provide increased impact resistance by providing a redundant-case-protection-means for the angle grinder during use. In a preferred embodiment, the first-half-body-section and the second-half-body-section are removably coupleable by a plurality of clips (or other such suitably equivalent means in alternate embodiments). The inner-shell may comprise vibration dampening material and the vibration dampening material may comprise rubber, in a preferred embodiment or other suitable material.

A preferred embodiment of the angle grinder control assembly may further include a handle to aid the user in controlling and manipulating the angle grinder during use. The handle is removably affixable to the angle grinder control assembly in the preferred embodiment and the handle is removably reconfigurable to be affixable to an opposite side of the angle grinder control assembly to provide ambidexterity for the user.

The tightening-rod is structured and arranged to allow the user to adjust the angle grinder control assembly against (in relation to) the body of the angle grinder in order to minimize vibration caused by operation of the angle grinder. The control-rod and the trigger are structured and arranged to allow the user to mechanically operate the angle-grinder-on/off-switch from an alternate location such that at least one hand of the user is in a safer position relative to the angle grinder. In a preferred embodiment the control-rod is substantially parallel to the body of the angle grinder.

In a preferred embodiment the return-spring and the trigger are structured and arranged such that the user must intentionally provide a force to the trigger operate the angle-grinder-on/off-switch. The control-rod-pin removably affixes the control-rod to the trigger. Using the present invention the angle grinder will not spin out of control when dropped.

The present invention holds significant improvements and serves as an angle grinder control system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, angle grinder control systems, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a power tools and more particularly to an angle grinder control system as used to improve the safety and reliability of an angle grinder during use. Generally speaking, an angle grinder control assembly can be easily operated by a user with a design that provides the user a safer use of an angle grinder while increasing the longevity of the angle grinder.

Figure 1:
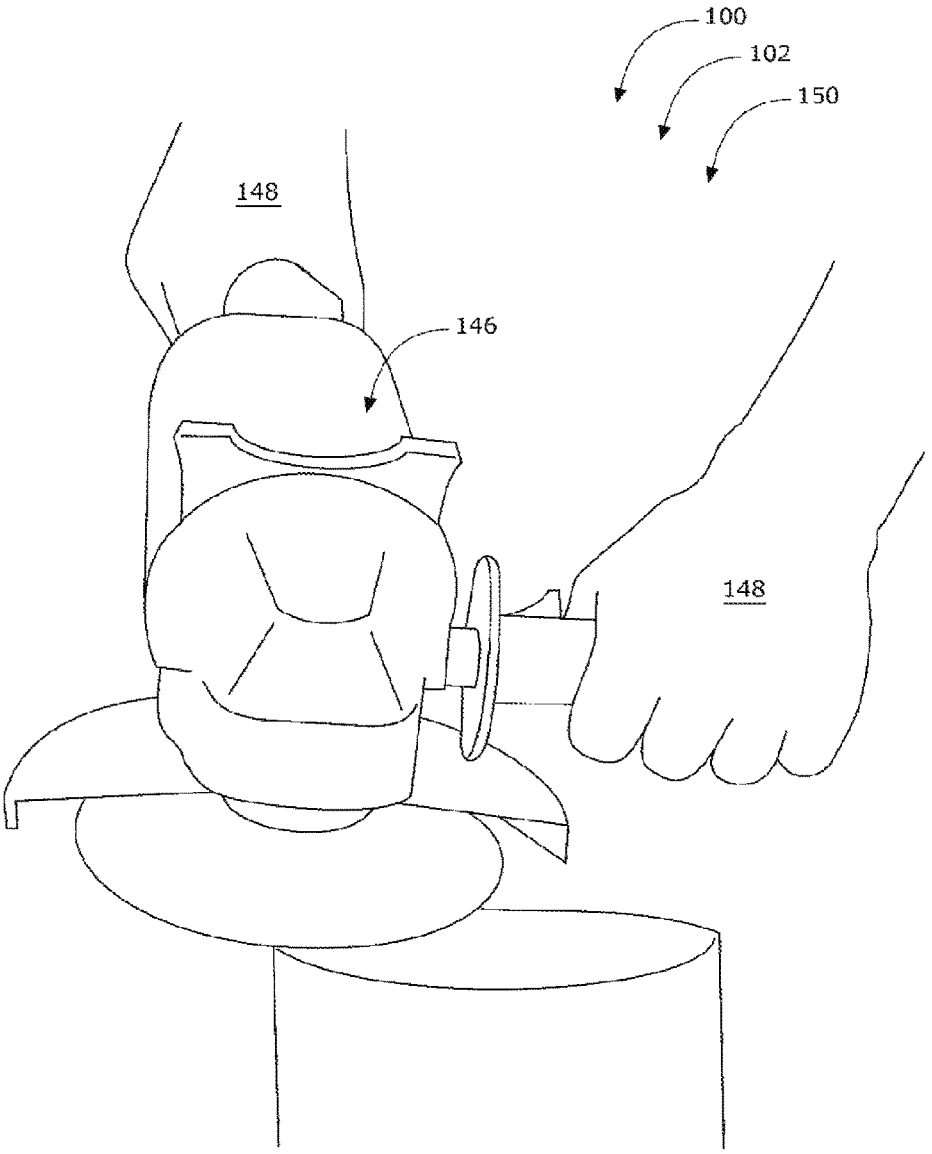
FIG. 1 shows a perspective view illustrating an angle grinder control system during an 'in-use' condition showing the relative position of the hand of the user while operating the angle grinder control system according to an embodiment of the present invention.
Figure 2:
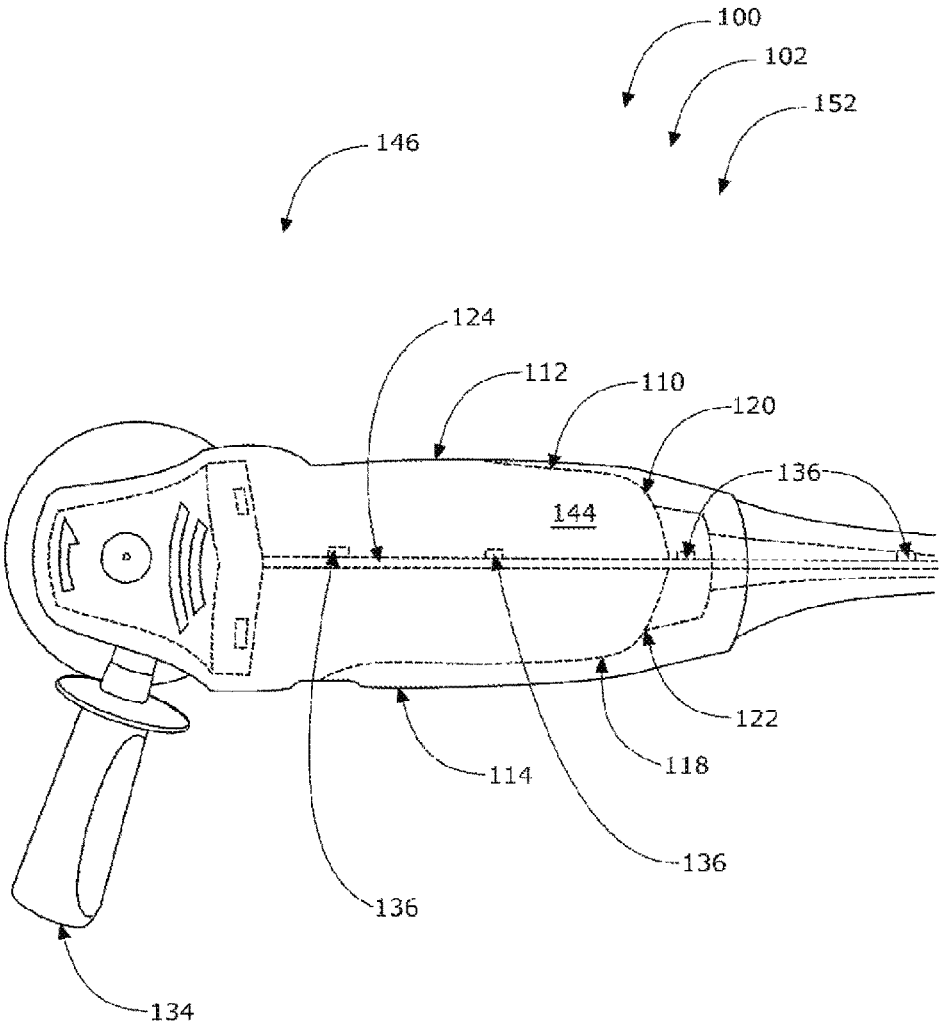
FIG. 2 is a perspective view illustrating the angle grinder control system comprising an angle grinder control assembly including an inner-shell, and outer-shell, a plurality of clips, and a handle according to an embodiment of the present invention of FIG. 1.
Figure 3:
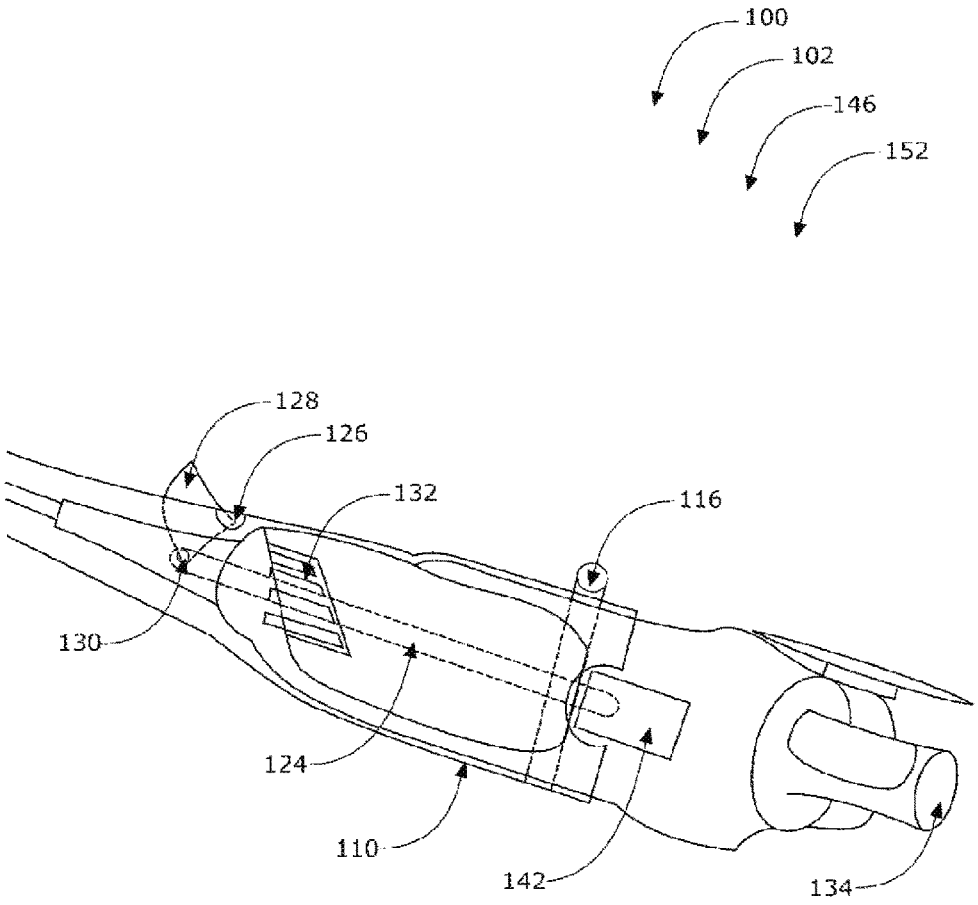
FIG. 3 is a perspective view illustrating the angle grinder control system comprising an outer-shell, a tightening-rod, a control-rod, a return-spring, a trigger, and a control-rod-pin according to an embodiment of the present invention of FIGS. 1-2.
Figure 4:
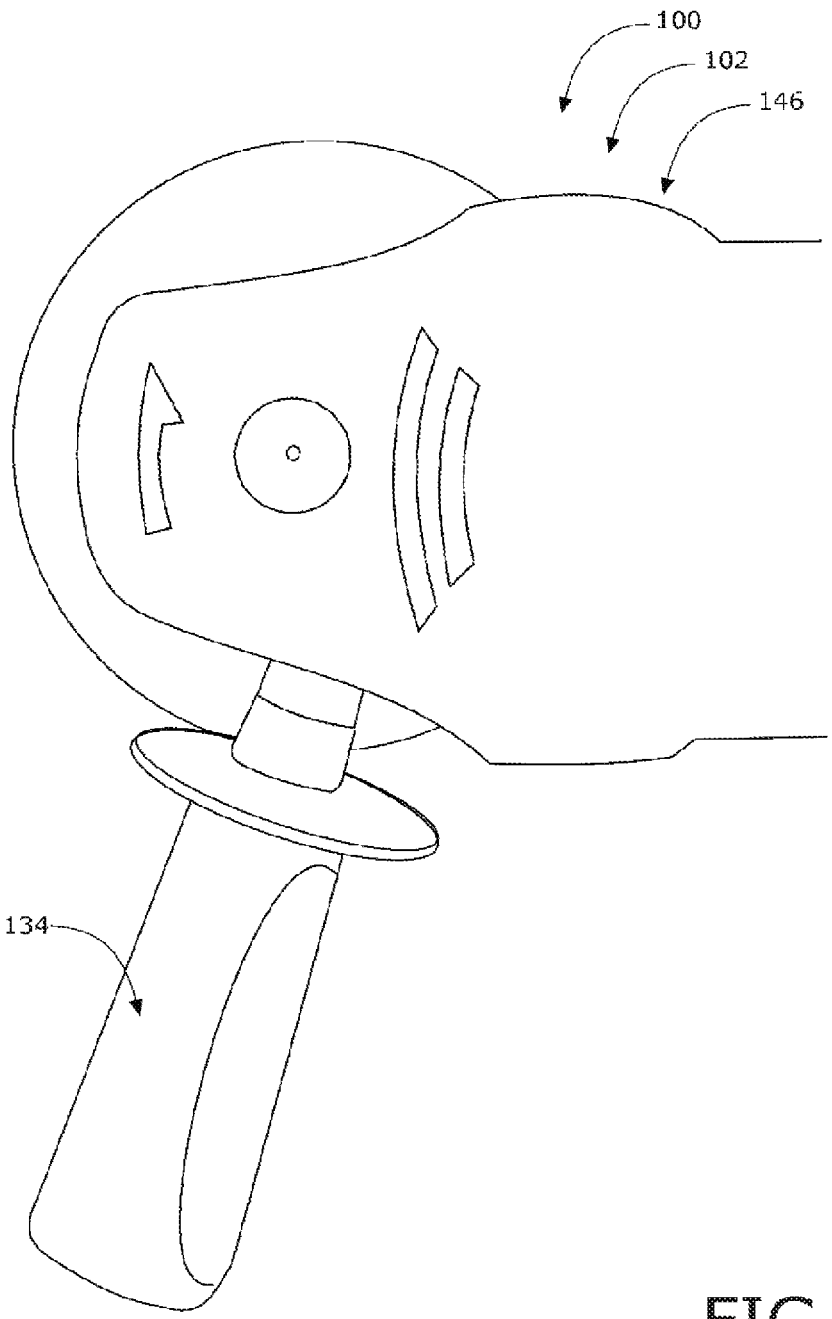
FIG. 4 is a perspective view illustrating the angle grinder control system including the handle according to an embodiment of the present invention of FIGS. 1-3.

Referring to the drawings by numerals of reference there is shown in FIGS. 1-4, an angle grinder control system 100 comprising angle grinder control assembly 102. Referring specifically to FIG. 1, showing angle grinder control system 100 during 'in-use' condition 150 according to an embodiment of the present invention.

In embodiments, angle grinder control system 100 comprises angle grinder control assembly 102. Angle grinder control system 100 provides safe use of angle grinder 146 in relation to user 140. Angle grinder control assembly 102 comprises outer-shell 110, inner-shell 118, tightening-rod 116, control-rod 124, return-spring 126, trigger 128, and control-rod-pin 130. Outer shell 110 comprises first-half-body-section 112 and second-half-body-section 114. Inner-shell 118 comprises primary-half-body-section 120 and secondary-half-body-section 122. Inner-shell 118 and outer-shell 110 are structured and arranged such that outer-shell 110, when in clamped condition, holds inner-shell 118 adjacent to angle grinder 146.

First-half-body-section 112 and second-half-body-section 114 of outer-shell 110 are structured and arranged to be removably affixable to each other in a clamped condition according to some embodiments. Further, outer-shell 110 and inner-shell 118 may provide increased impact resistance for angle grinder 146 during use, embodiments. Tightening-rod 116 may be structured and arranged to allow user 140 to adjust angle grinder control assembly 102 against a body of angle grinder 146 in order to minimize vibration caused by operation of angle grinder 146.

Control-rod 125 and trigger 128 are structured and arranged to allow user 140 to mechanically operate angle-grinder-on/off-switch 142 from an alternate location such that at least one hand 148 of user 140 is in a safer position relative to angle grinder 146. Embodiments may include configurations such that control-rod 124 is substantially parallel to body of angle grinder 146. Return-spring 126 and trigger 128 are structured and arranged such that user 146 must purposely provide a force to trigger 128 operate angle-grinder-on/off-switch 142. Control-rod-pin 130 removably affixes control-rod 124 to trigger 128.

Embodiments of angle grinder control system 100 may further include outer-shell 110 which comprises air vents 132 to aid in cooling of angle grinder 146. Such embodiments may include air vents 132 which are configured on opposing sides of the body of angle grinder 146 so as to not interfere with use of angle grinder 146 by user 140. Additional embodiments may include air vents 132 located on opposing sides of the body of angle grinder 146 such that when used at least one hand of user 140 does not substantially obstruct air flow into air vents 132.

Alternate embodiments of angle grinder control assembly 102 may further comprise handle 134 to aid user 140 in controlling and manipulating angle grinder 146 during use and handle 134 may be removably affixable to angle grinder control assembly 102 in some embodiments. Additionally, handle 134 may be removably reconfigurable to be affixable to an opposite side of angle grinder control assembly 102 to provide ambidexterity (alternate left—and right-hand usage) for user 140.

Embodiments of angle grinder control system may include first-half-body-section 112 and second-half-body-section 114 removably coupleable by a plurality of fasteners. Alternate embodiments may include first-half-body-section 112 and second-half-body-section 114 removably coupleable by hook and loop strips (i.e., Velcro). Further embodiments may include first-half-body-section 112 and second-half-body-section 114 removably coupleable by plurality of clips 136 or first-half-body-section 112 and second-half-body-section 114 may be removably coupleable by a plurality of biasers.

Inner-shell 118 of angle grinder control system 100 may comprise vibration dampening material, in embodiments, and may include vibration dampening material comprised of rubber or other deformable material.

Angle grinder control system 100 is structured and arranged to provide user 140 an alternate means for controlling angle-grinder-on/off-switch 142 and angle grinder control system 100 may increase longevity of angle grinder 146 due to a decrease in integral loads on angle grinder 146 during use.

An angle grinder control system 100 may be sold as kit 440 comprising the following parts: at least one angle grinder control assembly 102; at least one plurality of clips 136; and at least one set of user instructions. The kit has instructions such that functional relationships are detailed in relation to the structure of the invention (such that the invention can be used, maintained, or the like in a preferred manner). Angle grinder control system 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different fastening, clamping, vibration dampening combinations, parts may be sold separately, etc., may be sufficient.

Figure 5:
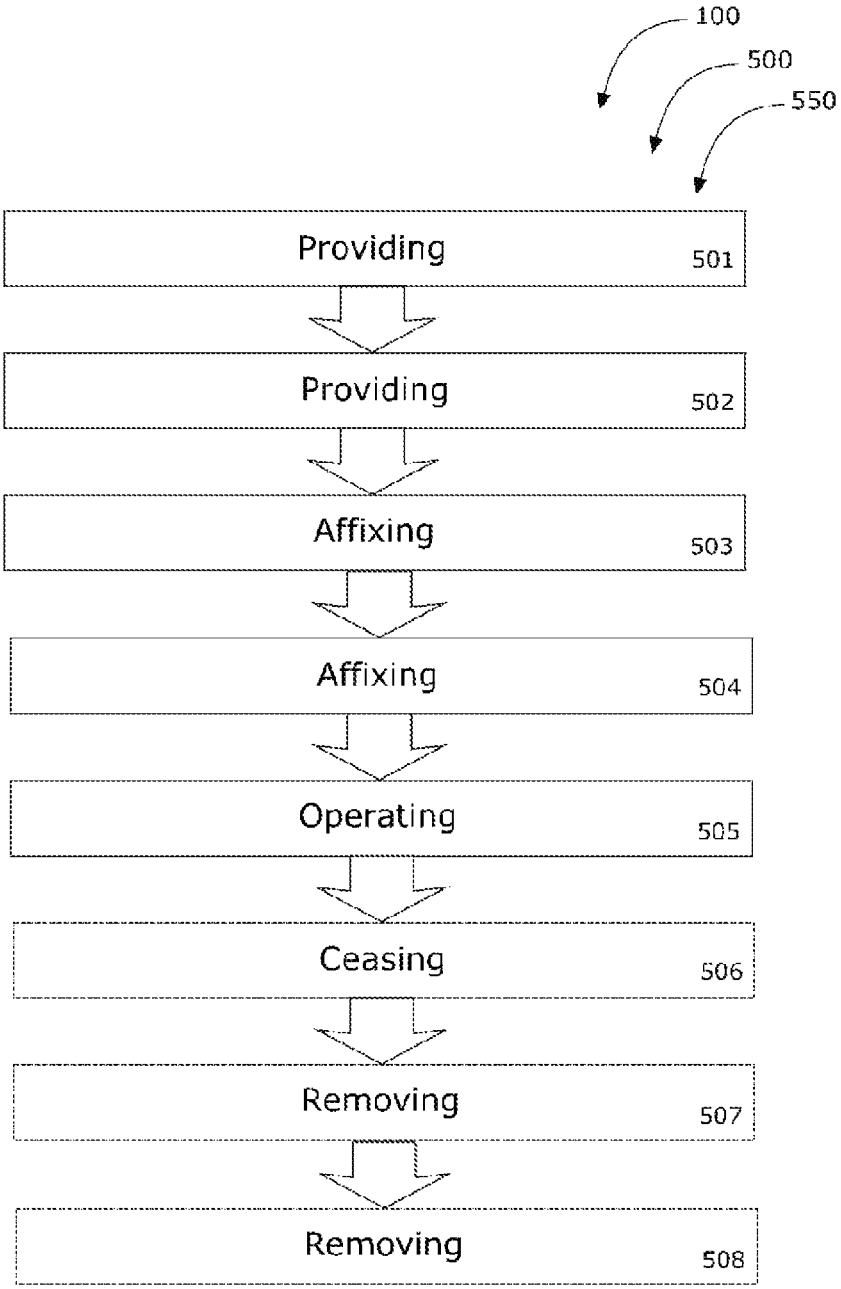
FIG. 5 is a flowchart illustrating a method of use for the angle grinder control system according to an embodiment of the present invention of FIGS. 1-4.

Referring now to FIG. 5 showing flowchart 550 illustrating method of use 500 for angle grinder control system 100 according to an embodiment of the present invention of FIGS. 1-4.

As shown, method of use 500 may comprise the steps of: step one 501, providing angle grinder control assembly 102; step two 502, providing plurality of clips 136; step three 503, affixing angle grinder control assembly 102 to angle grinder 146; step four 504, affixing plurality of clips 136 to angle grinder control assembly 102; step five 505, operating angle grinder 146; step six 506, ceasing operation of angle grinder 146; step seven 507, removing plurality of clips from angle grinder control assembly 102; and step eight 508, removing angle grinder control assembly 102 from angle grinder 146.

It should be noted that steps six 506-508 are optional steps and may not be implemented in all cases. Optional steps of method of use 500 are illustrated using dotted lines in FIG. 5 so as to distinguish them from the other steps of method of use 500.

It should be noted that the steps described in the method of use can be carried out in many different orders according to user preference. The use of "step of" should not be interpreted as "step for", in the claims herein and is not intended to invoke the provisions of 35 U.S.C. §112, ¶6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. An angle grinder control system comprising:

an angle grinder control assembly comprising;
- an outer-shell comprising;
  - a first-half-body-section; and
  - a second-half-body-section;
- a tightening-rod;
- an inner-shell comprising;
  - a primary-half-body-section; and
  - a secondary-half-body-section;
- a control-rod;
- a return-spring;
- a trigger; and
- a control-rod-pin;

wherein said angle grinder control system comprises said angle grinder control assembly;

wherein said angle grinder control assembly comprises said outer-shell, said tightening-rod, said inner-shell, said control-rod, said return-spring, said trigger, and control-rod-pin;

wherein said outer-shell comprises said first-half-body-section and said second-half-body-section;

wherein said first-half-body-section and said second-half-body-section of said outer-shell are structured and arranged to be removably affixable to each other in a clamped condition;

wherein said inner-shell comprises said primary-half-body-section and said secondary-half-body- section;

wherein said angle grinder control system is structured and arranged to provide a user an alternate means for controlling an angle-grinder-on/off-switch;

wherein said tightening-rod is structured and arranged to allow said user to adjust said angle grinder control assembly against a body of an angle grinder in order to minimize vibration caused by operation of said angle grinder;

wherein said inner-shell and said outer-shell are structured and arranged such that said outer-shell when in said clamped condition holds said inner-shell adjacent to said angle grinder;

wherein said control-rod and said trigger are structured and arranged to allow said user to mechanically operate said angle-grinder-on/off-switch from an alternate location such that at least one hand of said user is in a safer position relative to said angle grinder;

wherein said return-spring and said trigger are structured and arranged such that said user must purposely provide a force to said trigger operate said angle-grinder-on/off-switch;

wherein said control-rod-pin removably affixes said control-rod to said trigger; and wherein said angle grinder control system provides safe use of said angle grinder in relation to said user.

2. The angle grinder control system of claim 1 wherein said outer-shell further comprises air vents to aid in cooling of said angle grinder.

3. The angle grinder control system of claim 2 wherein said air vents are configured on opposing sides of said body of said angle grinder so as to not interfere with use of said angle grinder by said user.

4. The angle grinder control system of claim 3 wherein said air vents are located on said opposing sides of said body of said angle grinder such that when used said at least one hand of said user does not substantially obstruct air flow into said air vents.

5. The angle grinder control system of claim 1 wherein said angle grinder control assembly further comprises a handle to aid said user in controlling and manipulating said angle grinder during use.

6. The angle grinder control system of claim 5 wherein said handle is removably affixable to said angle grinder control assembly.

7. The angle grinder control system of claim 6 wherein said handle is removably reconfigurable to be affixable to an opposite side of said angle grinder control assembly to provide ambidexterity for said user.

8. The angle grinder control system of claim 1 wherein said first-half-body-section and said second-half-body-section are removably coupleable by a plurality of fasteners.

9. The angle grinder control system of claim 1 wherein said first-half-body-section and said second-half-body-section are removably coupleable by hook and loop strips.

10. The angle grinder control system of claim 8 wherein said first-half-body-section and said second-half-body-section are removably coupleable by a plurality of clips.

11. The angle grinder control system of claim 10 wherein said first-half-body-section and said second-half-body-section are removably coupleable by a plurality of biasers.

12. The angle grinder control system of claim 1 wherein said inner-shell comprises vibration dampening material.

13. The angle grinder control system of claim 12 wherein said vibration dampening material comprises rubber.

14. The angle grinder control system of claim 1 wherein said control-rod is substantially parallel to said body of said angle grinder.

15. The angle grinder control system of claim 1 wherein said outer-shell and said inner-shell provide increased impact resistance for said angle grinder during use.

16. The angle grinder control system of claim 1 wherein said angle grinder control assembly increases longevity of said angle grinder due to a decrease in integral loads on said angle grinder during use.

17. An angle grinder control system comprising:

an angle grinder control assembly comprising;
- an outer-shell comprising;
  - a first-half-body-section; and
  - a second-half-body-section;
- a tightening-rod;
- an inner-shell comprising;
  - a primary-half-body-section; and
  - a secondary-half-body-section;
- a control-rod;
- a return-spring;
- a trigger; and
- a control-rod-pin;

wherein said angle grinder control system comprises said angle grinder control assembly;

wherein said angle grinder control assembly comprises said outer-shell, said tightening-rod, said inner-shell, said control-rod, said return-spring, said trigger, and control-rod-pin;

wherein said outer-shell comprises said first-half-body-section and said second-half-body-section;

wherein said first-half-body-section and said second-half-body-section of said outer-shell are structured and arranged to be removably affixable to each other in a clamped condition;

wherein said inner-shell comprises said primary-half-body-section and said secondary-half-body- section;

wherein said angle grinder control system is structured and arranged to provide a user an alternate means for controlling an angle-grinder-on/off-switch;

wherein said tightening-rod is structured and arranged to allow said user to adjust said angle grinder control assembly against a body of an angle grinder in order to minimize vibration caused by operation of said angle grinder;

wherein said inner-shell and said outer-shell are structured and arranged such that said outer-shell when in said clamped condition holds said inner-shell adjacent to said angle grinder;

wherein said control-rod and said trigger are structured and arranged to allow said user to mechanically operate said angle-grinder-on/off-switch from an alternate location such that at least one hand of said user is in a safer position relative to said angle grinder;

wherein said return-spring and said trigger are structured and arranged such that said user must intentionally provide a force to said trigger operate said angle-grinder-on/off-switch;

wherein said control-rod-pin removably affixes said control-rod to said trigger;

wherein said outer-shell further comprises air vents to aid in cooling of said angle grinder;

wherein said air vents are configured on opposing sides of said body of said angle grinder as to not interfere with use of said angle grinder by said user;

wherein said air vents are located on said opposing sides of said body of said angle grinder such that when used said at least one hand of said user does not obstruct air flow into said air vents;

wherein said angle grinder control assembly further comprises a handle to aid said user in controlling and manipulating said angle grinder during use;

wherein said handle is removably affixable to said angle grinder control assembly;

wherein said handle is removably reconfigurable to be affixable to an opposite side of said angle grinder control assembly to provide ambidexterity for said user;

wherein said first-half-body-section and said second-half-body-section are removably coupleable by a plurality of clips;

wherein said inner-shell comprises vibration dampening material;

wherein said vibration dampening material comprises rubber;

wherein said control-rod is substantially parallel to said body of said angle grinder;

wherein said outer-shell and said inner-shell provide increased impact resistance by providing a redundant-case-protection-means for said angle grinder during use; and wherein said angle grinder control system provides safe use of said angle grinder in relation to said user.

18. The angle grinder control system of claim 17 further comprising a kit including:

said angle grinder control assembly;

said plurality of clips; and a set of user instructions.

19. A method of using the angle grinder control system of claim 17 comprising the steps of:

providing an angle grinder control assembly;

providing a plurality of clips;

affixing said angle grinder control assembly to an angle grinder;

affixing said plurality of clips to said angle grinder control assembly; and operating said angle grinder.

20. The method of claim 19 further comprising the steps of:

ceasing operation of said angle grinder;

removing said plurality of clips from said angle grinder control assembly; and removing said angle grinder control assembly from said angle grinder.

* * * * *